US009317009B2

(12) United States Patent
Fowler

(10) Patent No.: US 9,317,009 B2
(45) Date of Patent: Apr. 19, 2016

(54) SYSTEMS AND METHODS FOR MOUNTING AN EXTERNALLY READABLE MONITORING MODULE ON A ROTATING CUSTOMER REPLACEABLE COMPONENT IN AN OPERATING DEVICE

(71) Applicant: XEROX Corporation, Norwalk, CT (US)

(72) Inventor: Jeffrey Michael Fowler, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/184,666

(22) Filed: Feb. 19, 2014

(65) Prior Publication Data

US 2015/0234347 A1 Aug. 20, 2015

(51) Int. Cl.

| | |
|---|---|
| ***G03G 15/00*** | (2006.01) |
| ***G03G 21/18*** | (2006.01) |
| *G03G 15/08* | (2006.01) |

(52) U.S. Cl.

CPC ..... *G03G 21/1882* (2013.01); *G03G 15/0863* (2013.01); *G03G 15/0832* (2013.01); *G03G 15/55* (2013.01); *G03G 15/553* (2013.01); *G03G 2215/0697* (2013.01); *G03G 2221/1823* (2013.01)

(58) Field of Classification Search

CPC ..... G03G 15/08
USPC ..... 399/12
See application file for complete search history.

(56) References Cited

U.S. PATENT DOCUMENTS

| | | | | |
|---|---|---|---|---|
| 4,961,088 | A * | 10/1990 | Gilliland et al. | 399/25 |
| 5,289,242 | A * | 2/1994 | Christensen et al. | 399/12 |
| 5,675,534 | A * | 10/1997 | Hewitt et al. | 365/185.04 |
| 6,181,885 | B1 * | 1/2001 | Best et al. | 399/12 |
| 6,227,643 | B1 * | 5/2001 | Purcell et al. | 347/19 |
| 6,233,409 | B1 * | 5/2001 | Haines et al. | 399/10 |
| 6,351,621 | B1 * | 2/2002 | Richards et al. | 399/111 |
| 6,532,351 | B2 * | 3/2003 | Richards et al. | 399/111 |
| 6,685,298 | B2 * | 2/2004 | Walker | 347/19 |
| 6,694,106 | B2 * | 2/2004 | Yoshimura | 399/12 |
| 6,710,891 | B1 * | 3/2004 | Vraa et al. | 358/1.12 |
| 6,850,714 | B2 * | 2/2005 | Sakurai et al. | 399/25 |
| 6,865,349 | B2 * | 3/2005 | Silence et al. | 399/8 |
| 6,892,033 | B2 * | 5/2005 | Sunada et al. | 399/13 |
| 6,895,191 | B2 * | 5/2005 | Rommelmann et al. | 399/12 |
| 7,053,776 | B2 * | 5/2006 | Phipps et al. | 340/572.1 |

(Continued)

*Primary Examiner* — Clayton E Laballe
*Assistant Examiner* — Kevin Butler
(74) *Attorney, Agent, or Firm* — Ronald E. Prass, Jr.; Prass LLP

(57) ABSTRACT

A system and method are provided for facilitating high quality communications in an image forming device by providing a mechanism that fixes a position of an electronically readable/writable memory module, such as a customer replaceable unit monitor (CRUM) for a rotatable customer replaceable unit (CRU), with respect to a CRUM reader in the image forming device. A ring-like mounting device is non-fixedly attached to the CRU in a manner that limits axial relative movement between the ring-like mounting device and the CRU along a rotating axis of the CRU. The non-fixed attachment of the ring-like mounting device to the CRU is effected in such a manner so as not to inhibit relative rotational movement. In operation, a projection from the ring-like mounting device stops rotation of the ring-like mounting device, and therefore the CRUM mounted thereon, with respect to the image forming device structure, and specifically the CRUM reader.

18 Claims, 4 Drawing Sheets

(56) References Cited

U.S. PATENT DOCUMENTS 7,062,181 B2 * 6/2006 Buchheit ..... 399/24
7,101,014 B2 * 9/2006 Johnson et al. ..... 347/19
7,106,198 B2 * 9/2006 Phipps et al. ..... 340/572.1
7,158,032 B2 * 1/2007 Rodriguez et al. ..... 340/572.1
7,182,445 B2 * 2/2007 Johnson et al. ..... 347/86
7,196,627 B2 * 3/2007 Rommelmann et al. ... 340/572.8
7,197,633 B2 * 3/2007 Rommelmann et al. ..... 713/1
7,218,886 B2 * 5/2007 Hildebrand et al. ..... 399/343
7,231,153 B2 * 6/2007 May ..... 399/25
7,280,251 B1 * 10/2007 Holub ..... 358/1.9
7,315,708 B2 * 1/2008 Burchette et al. ..... 399/109
7,321,966 B2 * 1/2008 Koontz et al. ..... 713/1
7,334,261 B2 * 2/2008 Koontz et al. ..... 726/17
7,346,285 B2 * 3/2008 Nagahama et al. ..... 399/8
7,408,663 B2 * 8/2008 Kato et al. ..... 358/1.15
7,432,817 B2 * 10/2008 Phipps et al. ..... 340/572.7
7,434,053 B2 * 10/2008 Parry et al. ..... 713/171
7,471,905 B2 * 12/2008 Cook ..... 399/24
7,504,951 B2 * 3/2009 Phipps et al. ..... 340/572.7
7,526,438 B1 * 4/2009 Harper et al. ..... 705/26.1
7,589,850 B2 * 9/2009 Adkins et al. ..... 358/1.15
7,641,606 B2 * 1/2010 Watanabe ..... 492/10
7,642,916 B2 * 1/2010 Phipps et al. ..... 340/572.7
7,653,570 B2 * 1/2010 May ..... 399/107
7,664,257 B2 * 2/2010 Hohberger et al. ..... 380/22
7,747,179 B2 * 6/2010 Ahn ..... 399/25
7,769,619 B1 * 8/2010 Krysinski et al. ..... 705/7.13
7,831,458 B2 * 11/2010 Neumann ..... 705/7.25
7,859,412 B2 * 12/2010 Kothari et al. ..... 340/572.1
7,886,197 B2 * 2/2011 Wegman ..... 714/44
7,917,087 B2 * 3/2011 Harumoto ..... 455/41.2
7,941,061 B2 * 5/2011 Kadowaki ..... 399/12
7,963,645 B2 * 6/2011 Rodriguez et al. ..... 347/88
8,167,421 B2 * 5/2012 Rodriguez et al. ..... 347/99
8,176,549 B2 * 5/2012 Lee et al. ..... 726/20
8,280,264 B2 * 10/2012 Inoue ..... 399/27
8,386,292 B2 * 2/2013 Moser ..... 705/7.27
RE44,220 E * 5/2013 Turner et al. ..... 713/182
8,666,263 B2 * 3/2014 Zhang ..... 399/12
8,714,851 B2 * 5/2014 Preliasco et al. ..... 400/611
8,721,203 B2 * 5/2014 Ehrhardt, Jr. ..... 400/120.01
8,947,716 B2 * 2/2015 Wang ..... 358/1.15
2002/0021909 A1 * 2/2002 Harumoto ..... 399/27
2003/0035657 A1 * 2/2003 Asano et al. ..... 399/53
2005/0105721 A1 * 5/2005 Ono ..... 380/51
2005/0196180 A1 * 9/2005 Harumoto ..... 399/12
2005/0258932 A1 * 11/2005 Phipps et al. ..... 340/5.1
2005/0258963 A1 * 11/2005 Rodriguez et al. ..... 340/572.1
2006/0013600 A1 * 1/2006 Kang ..... 399/13
2006/0045549 A1 * 3/2006 Ahn ..... 399/25
2006/0085279 A1 * 4/2006 Lee ..... 705/26
2006/0093383 A1 * 5/2006 Buchheit ..... 399/24
2006/0115281 A1 * 6/2006 Kim et al. ..... 399/8
2006/0133609 A1 * 6/2006 Rodriguez et al. ..... 380/201
2006/0224472 A1 * 10/2006 May ..... 705/28
2007/0047974 A1 * 3/2007 Tanaka ..... 399/8
2007/0047976 A1 * 3/2007 Hamby et al. ..... 399/12
2008/0166144 A1 * 7/2008 Lee et al. ..... 399/27
2008/0181628 A1 * 7/2008 Ahn ..... 399/27
2008/0286012 A1 * 11/2008 Saito et al. ..... 399/258
2008/0286014 A1 * 11/2008 Saito et al. ..... 399/263
2008/0304837 A1 * 12/2008 Park ..... 399/25
2008/0310070 A1 * 12/2008 Wegman ..... 361/103
2009/0034991 A1 * 2/2009 Jun ..... 399/12
2009/0064015 A1 * 3/2009 You ..... 715/764
2009/0129827 A1 * 5/2009 Ichikawa et al. ..... 399/262
2009/0175632 A1 * 7/2009 Kim ..... 399/12
2009/0214249 A1 * 8/2009 Lee et al. ..... 399/90
2009/0219559 A1 * 9/2009 Lee et al. ..... 358/1.14
2010/0028031 A1 * 2/2010 Lee et al. ..... 399/44
2010/0209122 A1 * 8/2010 Ishino ..... 399/12
2010/0316414 A1 * 12/2010 Saito et al. ..... 399/258
2010/0322666 A1 * 12/2010 Inomata et al. ..... 399/120
2010/0329700 A1 * 12/2010 Sakai et al. ..... 399/13
2011/0076061 A1 * 3/2011 Tsumita et al. ..... 399/262
2011/0093702 A1 * 4/2011 Eom et al. ..... 713/168
2011/0123229 A1 * 5/2011 Takashima et al. ..... 399/254
2011/0158669 A1 * 6/2011 Kayahara ..... 399/53
2011/0236038 A1 * 9/2011 Saito et al. ..... 399/13
2012/0051781 A1 * 3/2012 Kubo et al. ..... 399/111
2012/0063792 A1 * 3/2012 Kim ..... 399/27
2012/0076526 A1 * 3/2012 Awano et al. ..... 399/91
2012/0099887 A1 * 4/2012 Shokaku ..... 399/102
2012/0099892 A1 * 4/2012 Sakai ..... 399/110
2012/0099901 A1 * 4/2012 Sakai ..... 399/258
2012/0132559 A1 * 5/2012 Okuma et al. ..... 206/524.1
2012/0148289 A1 * 6/2012 Lee et al. ..... 399/90
2012/0222776 A1 * 9/2012 Sakamoto et al. ..... 141/369
2013/0028617 A1 * 1/2013 Fukuoka et al. ..... 399/27
2013/0063770 A1 * 3/2013 Lee et al. ..... 358/1.15
2013/0155459 A1 * 6/2013 Jeong et al. ..... 358/1.15
2013/0188213 A1 * 7/2013 Burke et al. ..... 358/1.14
2013/0308961 A1 * 11/2013 Kim et al. ..... 399/10
2013/0321853 A1 * 12/2013 Lee et al. ..... 358/1.14
2014/0056599 A1 * 2/2014 Spink ..... 399/12
2014/0082302 A1 * 3/2014 Rommelmann et al. ..... 711/154
2014/0164725 A1 * 6/2014 Jang et al. ..... 711/163
2014/0239056 A1 * 8/2014 Tsongas et al. ..... 235/375
2014/0270812 A1 * 9/2014 Scrafford et al. ..... 399/12
2014/0294436 A1 * 10/2014 Ishiguro et al. ..... 399/107
2014/0294447 A1 * 10/2014 Ishiguro et al. ..... 399/258
2015/0003847 A1 * 1/2015 Yang et al. ..... 399/27

* cited by examiner

SYSTEMS AND METHODS FOR MOUNTING AN EXTERNALLY READABLE MONITORING MODULE ON A ROTATING CUSTOMER REPLACEABLE COMPONENT IN AN OPERATING DEVICE

BACKGROUND

1. Field of the Disclosed Embodiments

This disclosure relates to systems and methods for uniquely mounting an electronically-readable/writable monitoring module, such as a customer replaceable unit monitor (CRUM), associated with a rotatable customer replaceable component or unit (CRU) in a manner that renders the monitoring module stationary in operation relative to a monitoring module reader in an operating device, including an image forming device, without restricting rotation of the rotatable CRU.

2. Related Art

Virtually all classes of operating devices, and particularly image forming devices, include one or more customer replaceable components or units (CRUs). Many of these CRUs are routinely replaceable based on an indication of an end of service life condition for the CRUs, or exhaustion of consumable products, such as ink and toner in image forming devices, packaged in the CRUs. The service life of a particular CRU, or the consumable product level in the CRU, can be tracked and measured, for example, according to a number of operations that the CRU may undertake in the operating device. For the purposes of this disclosure, the terms of CRU and consumable may be used interchangeably.

Image forming devices make extensive beneficial use of a capacity to externally monitor the status of the one or more CRUs in the image forming devices. The monitoring of the CRUs is often implemented by way of an electronically-readable monitoring module associated with the CRU for tracking and/or reporting one or more characteristics of the CRU that is read by a compatible monitoring module reader mounted in the image forming device in which the CRU is installed for use. The monitored one or more characteristics can include static information, i.e., information that does not change over the usable service life of the CRU, such as a model or serial number and/or an indicator of compatibility of the CRU with the image forming device within which the CRU is installed for use. The monitoring module can also be used to record, via the compatible monitoring module reader when operated in a write mode, dynamically changing information relating to a particular characteristic of the CRU in an electronically-readable format. Such dynamic characteristic information may include, for example, information on use, maintenance, failures, diagnostics, remanufacture, remaining service life or remaining consumable level(s), among other characteristics, of the CRU.

Outputs from these monitoring modules are received locally, via the compatible monitoring module reader, by circuitry in the image forming devices that implements reading from and writing to the monitoring modules. A user may be presented with information regarding the outputs from these monitoring modules at the device via some manner of graphical user interface (GUI) associated with the image forming device within which the CRU is installed.

U.S. Pat. No. 6,351,621 to Richards et al., which is commonly assigned and the disclosure of which is incorporated herein by reference in its entirety, discloses CRUs that are augmented with electronically-readable/writable monitoring chips containing static information for identification of the CRU, and/or dynamic information relating to an operating status of the CRU. Richards et al. refer to such electronically-readable/writable monitoring chips as customer replaceable unit monitors or CRUMs.

Richards et al. explain that, when an individual CRU is installed in an image forming device, communication is established with the CRUM located within, or externally mounted to, the individual CRU. The CRUM enables the image forming device to track one or more characteristics of the CRU by reading data from, and potentially updating the information contained by writing data to, the CRUM.

SUMMARY OF THE DISCLOSED EMBODIMENTS

Since Richards et al. was patented, a proliferation in the use of CRUMs has greatly increased as the information contained in CRUMs has been expanded to support a number of additional beneficial functions. CRUMs are widely employed today, for example, in efforts to curtail the use of "gray" market components by image forming device user entities. In this role, CRUMs provide increasingly sophisticated compatibility information that the image forming device must read from the CRUM regarding a replacement CRU before the image forming device will accept the CRU as authorized for use in and/or compatible with the image forming device within which the CRU is installed for use. Upon replacement of the CRU, this necessary verification step, using information read from the CRUM, may be required before inhibiting software in the image forming device allows further image forming operations to proceed after the installation of the replacement CRU. In this manner, the CRUM can be used to address issues of fraud and security with regard to specified CRUs in image forming devices. Specifically, the CRUM provides a vehicle by which the CRU is made to communicate to the image forming device within which the CRU is installed to provide compatibility information to tell the image forming device that a replacement CRU is an authorized or compatible CRU provided by the manufacturer of the image forming device, e.g., a device manufacturer proprietary device rather than a copy or counterfeit device. This is but an example of the expanding role of CRUM technologies in use in image forming devices.

Based on their increasingly recognized importance in correctly identifying, and monitoring characteristics of, the CRUs with which they are associated, increasingly sophisticated design and development efforts are focused on CRUM technologies. These efforts are directed at all aspects of improving CRUM employment in the image forming devices within which the CRUs with which the CRUMs are associated are installed for use. One particular area of study centers on maintaining a fidelity of reliable communications between the CRUMs and the image forming devices.

CRUMs are generally particularly adapted to the CRUs with which they are associated. When a CRUM is added to a rotating toner bottle as the CRU, for example, the CRUM must generally be a wireless-communication type device, unless a specific embedding and wired connectivity scheme is implemented. Such a scheme, however, may add costly injection-molded parts to the rotating toner bottle.

Many attempted solutions aimed at addressing connectivity and communications issues between the image forming devices and the CRUMs, particularly those issues associated with rotating CRU components may raise attendant disadvantages. Implementation of a particular solution must always be balanced with an economic viability and/or efficiency of the implementation. One balance of these equities may arise when a wireless CRUM is adhered to an axial end of a rotating toner bottle. This configuration may generally necessitate implementing the read/write capability between the image forming device and separate CRUMs associated with each separate one of a plurality of different color toner rotating bottles by, for example, using separate individual costly monitoring module readers for communicating with each of the plurality of bottles. When wireless CRUMs are configured by being adhered to a side of two adjacent bottles in a color system, communications may be advantageously effected with two adjacent bottles sharing a single monitoring module reader. In such a configuration, however, each of the two CRUMs mounted, respectively, in fixed positions on each of the two rotating toner bottles may only be available for reading intermittent reading by the single monitoring module reader, i.e., once per toner bottle rotation. This intermittent reading is recognized to complicate software requirements and limit functionality.

In view of the above, it may be advantageous implement a CRUM mounting scheme that addresses the above-noted disadvantages in maintaining or increasing a fidelity of reliable communications between the CRUMs and the image forming devices within which the CRUs with which the CRUMs are associated are installed.

Exemplary embodiments of the systems and methods according this disclosure may implement a unique mounting procedure for a CRUM associated with a rotating component CRU, including a rotating toner or ink bottle in an image forming device, that may relatively simply render the CRUM, in use, stationary with respect to a CRUM reader in an operating device within which the rotating component CRU is installed for use.

Exemplary embodiments may provide a ring formed preferably of a flexible material, including, for example, a plastic film such as polycarbonate, that is configured to be non-fixedly assembled to a rotating component CRU, including a rotating ink or toner bottle, in a manner that restricts axial motion of the ring of flexible material with respect to the rotating component CRU.

Exemplary embodiments may provide the ring of flexible material configured to be non-fixedly assembled to the rotating component CRU in a manner that leaves the rotating component CRU free to move rotationally relative to the ring of flexible material.

Exemplary embodiments may provide, on the ring of flexible material, a structure, such as a tab, that protrudes from the ring in a manner that arrests motion of the ring in a particular position relative to the structure of the device, and particularly relative to a CRUM reader in the device.

Exemplary embodiments may fixedly mount a CRUM on, or in, the ring of flexible material at an advantageous location, relative, for example, to the protruding structure provided on the ring.

Exemplary embodiments may advantageously configure the ring of flexible material to cause the motion of the ring to be arrested by structural or mechanical interaction of a protruding structure with a fixed structure in the device such that the CRUM is caused to be stopped in a position to face the CRUM reader directly in a stationary manner while the rotating component CRU remains free to rotate with respect to the motion arrested ring and CRUM combination.

Exemplary embodiments may distinctly identify the CRU through markings, configurations or compositions of the ring of flexible material. In embodiments, for example, the ring of flexible material may be used for color-coding and/or labeling purposes, replacing existing labels so as to reduce a net cost of implementation of the disclosed embodiments. Rings may be particularly printed, printed on, and/or color coded, eliminating a need for a separate label to distinctly identify the rotatable CRU or its contents.

In embodiments, the CRUM may be a non-contact CRUM communicating by wireless means, RF, with the CRUM reader, but wired options are also possible. In particular, a wired CRUM may be packaged with flexible contacts and adhered to the ring of flexible material with terminals on the CRUM reader side located in the appropriate position and applying a slight pressure through the CRUM and ring of flexible material against the rotating component CRU.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for uniquely mounting an electronically-readable/writable monitoring module, such as a customer replaceable unit monitor (CRUM), associated with a rotatable customer replaceable component or unit (CRU) in a manner that renders the monitoring module stationary in operation relative to a monitoring module reader in a device without restricting rotation of the rotatable CRU, will be described, in detail, with reference to the following drawings, in which.

DETAILED DESCRIPTION OF THE DISCLOSED EMBODIMENTS

Figure 1:
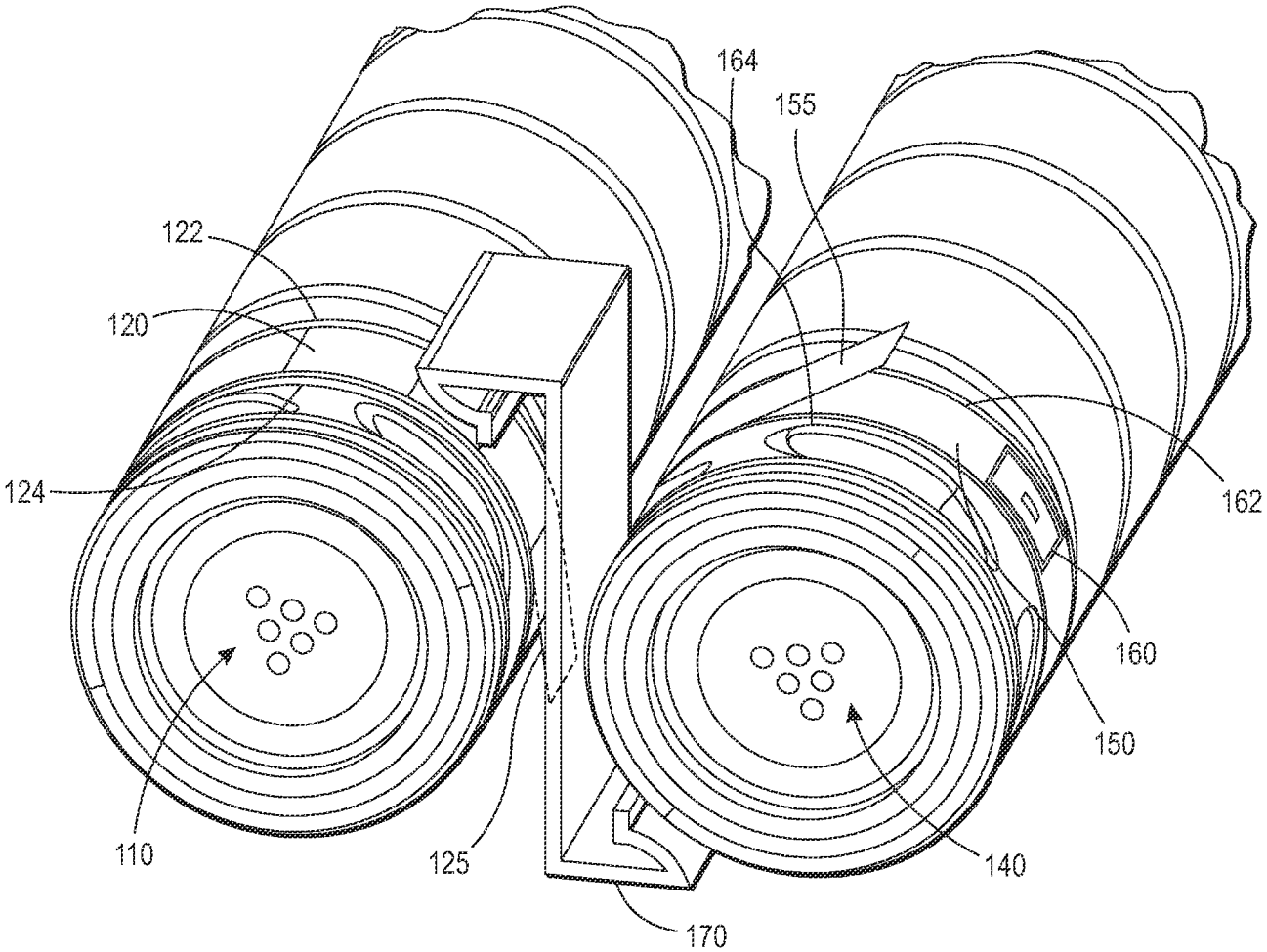
FIG. 1 illustrates an overview of placement of a pair of CRUs and specifically rotating toner bottles incorporating a particularly-configured rings formed of a flexible material and accommodating the respective CRUMs identifying each of the CRUs for use in image forming devices according to this disclosure.

The disclosed systems and methods for uniquely mounting an electronically-readable/writable monitoring module, such as a customer replaceable unit monitor (CRUM), associated with a rotatable customer replaceable component or unit (CRU) in a manner that renders the monitoring module stationary in operation relative to a monitoring module reader in an image forming device without restricting rotation of the rotatable CRU, will generally refer to this specific utility for those systems and methods. Exemplary embodiments of the disclosed systems and methods as described and depicted herein should not be interpreted as being specifically limited to any particular configuration of an image forming device, a CRU installed for use therein or a CRUM (as that term is recognized by those of skill in the art) associated with the CRU for monitoring one or more characteristics of the CRU as discussed generally above. Exemplary embodiments of the disclosed systems and methods are described and depicted herein should also not be interpreted as being limited to only the discussed particular intended use, which is presented for information, clarification and illustrative purposes only. Particularly, it should be noted that although the disclosed embodiments are described as being particularly adapted to CRUs in image forming devices, the disclosed concepts may find applicability in other devices involving rotating consumables, including, for example, spools. Virtually any device using at least one rotatable CRU supplying thread, fiber, filament, or cable from a spool may benefit from the disclosed schemes for a particular adaptation of CRUM technology. A CRUM may be placed, for example, on a disc comprising one end of the spool. If the CRUM could not be placed on the axis of rotation for some reason, it may be advantageous to halt the CRUM's rotation while allowing the spool to rotate. In such an embodiment, the disclosed concept may be presented in the form of a disc, rather than a circumferential band. Such embodiments may be usable in 3-D printers, textile manufacturing, electronics manufacturing, packaging, etc. In fact, any advantageous use of a rendered-immobile electronically-readable/writable component monitoring module associated with a rotatable replaceable consumable component in any fielded processor-controlled system or device that may benefit from the particularly-described cooperating elements specified in this disclosure for maintaining or increasing fidelity of communication between CRUMs and the devices within which rotatable CRUs with which those CRUMs are associated employing the methods, processes, techniques, schemes or structures discussed in this disclosure is contemplated.

Specific reference to, for example, any particular device, including an image forming device, such as a printer, copier, scanner, facsimile machine or multi-function device, particularly those including toner-based or ink-based image forming and/or fusing modules, should be understood as being exemplary only, and not limiting, in any manner, to any particular class of devices within which rotatable or rotating CRUs are installed for use. The systems and methods according to this disclosure will be described as being particularly adaptable to use in printing and/or copying devices such as, for example, xerographic image forming devices for printing and/or copying that employ various rotatable CRUs, and particularly rotatable toner or ink bottles, usable for facilitating forming and fusing of toner or inked images on image receiving media substrates, but should not be considered as being limited to only these types of devices. Any commonly known processor-controlled device in which the processor may require communication with and/or reference to stored operating parameters and values for controlling the device operations in that may be communicated to the device principally, or only, through communication established between the device and an electronically-readable monitoring module associated with a customer replaceable component or unit for installation and use in the device adapted according to the specific capabilities discussed in this disclosure is contemplated.

FIG. 1 illustrates an overview of placement 100 of a pair of rotatable CRUs 110,140, (and specifically rotating toner and/or ink bottles) incorporating particularly-configured rings 120,150 formed of a flexible material and accommodating respective CRUMs (see, e.g., element 160) identifying each of the rotatable CRUs 110, 140 for use in an image forming device according to this disclosure. As shown in FIG. 1, the exemplary overview 100 may include at least a pair of rotatable CRUs 110, 140 for marking material to a marking engine in an image forming device.

The pair of rotatable CRUs 110,140 may have associated with them a respective non-fixedly attached ring-like device 120,150 configured to include at least one structural projection 125,155. The respective non-fixedly attached ring-like devices 120,150 may be accommodated between respective pairs of positioning ribs 122,124 and 162,164, an objective of which is to limit axial movement of the respective ring-like devices 120,150 with respect to the rotatable CRUs 110,140. In embodiments, the respective ring-like devices 120,150, while limited in axial movement with respect to the rotatable CRUs 110,140 for individually configured in a manner that is intended not to restrict rotational movement of the rotatable CRUs 110,140 with respect to the ring-like devices 120,150. In this manner, any impediment to rotation of the individual ring-like devices 120,150 is intended not to impart any corresponding or substantially corresponding impediment to rotation of the rotatable CRUs 110,140.

Each of the ring-like devices 120,150 is intended to provide a platform for accommodation of one or more electronically-readable monitoring modules (see, e.g., element 160) by, for example, attaching to, or embedding within, the ring-like devices 120,150 the one or more electronically-readable monitoring modules. The ring-like devices 120,150 may be formed of a plastic film, such as polycarbonate, that is assembled to the rotatable CRUs 110,140 in such a manner that axial motion is restricted such as, for example, being restricted between the pairs of positioning ribs 122,124 and 162,164, while leaving the rotatable CRUs 110,140 free to move rotationally even in instances where rotational movement of the ring-like devices 120,150 is mechanically impeded such as, for example, by interaction of a projection 125,155, which may be in the form of a tab, protruding from the ring-like devices 120,150, which are intended to arrest the rotating motion of the ring-like devices 120,150 in a particular position relative to a fixed structure, such as a stopping structure 170, in an image forming device.

A relative positioning of the projections 125,155 and associated CRUMs adhered to the ring-like devices 120,150 in an advantageous location is intended to align the CRUMs with CRUM reading devices in the image forming devices when rotation of the ring-like devices 120,150 is arrested through interaction of the projections 125,155 with the fixed mechanical stopping structure 170 in the image forming device.

The ring-like devices 120,150 may be used for color-coding and labeling purposes, replacing existing labels in a manner that may lead to a reduction in a net cost of their use. In the embodiment shown in FIG. 1, for example, each of the respective ring-like devices 120,150 may be formed of a hypothetically different colored material, e.g., magenta and yellow, or any other like combination, to individually identify the rotatable CRU 110,140 (toner or ink bottles) with which they are associated.

Figure 2A:
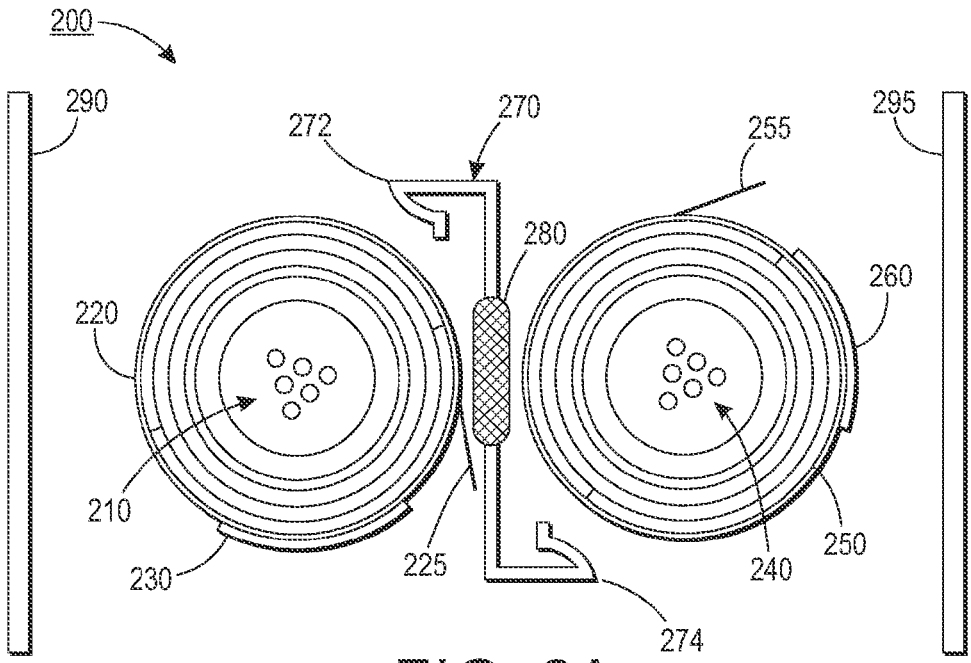
FIGS. 2A and 2B illustrate a more detailed overview of the interaction of the pair of CRUs incorporating the particularly-configured rings formed of a flexible material accommodating the respective CRUMs identifying each of the CRUs with a CRUM reader installation in an image forming device according to this disclosure.
Figure 2B:
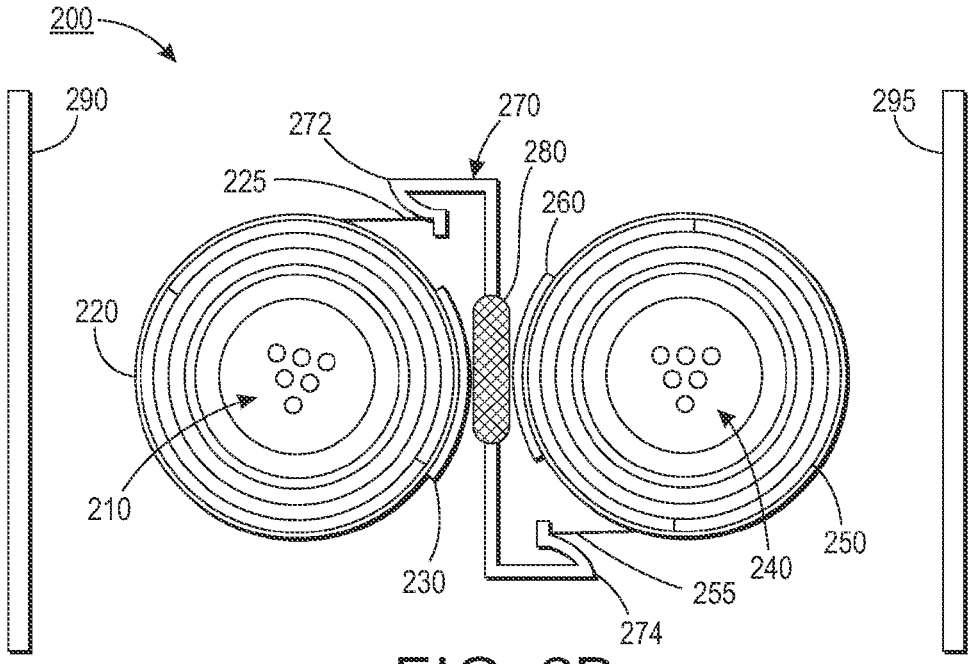

FIGS. 2A and 2B illustrate a more detailed overview 200 of an interaction of the pair of rotatable CRUs 210,240 incorporating particularly-configured non-fixedly attached rings 220, 250 formed of a flexible material accommodating respective CRUMs 230,260 identifying each of the CRUs 210,240 with a CRUM reader 280 installation on a cooperative stopping device structure 270 in an image forming device according to this disclosure. As shown in FIGS. 2A and 2B, the detailed overview 200 may include at least a pair of rotatable CRUs 210,240 that are container structures containing marking materials such as, for example, inks or toners, to be supplied for operation to a marking engine in the image forming device.

The pair of rotatable CRUs 210,240 may have associated with them a respective non-fixedly attached ring-like device 220,250 configured to include at least one structural projection 225,255. The respective non-fixedly attached ring-like devices 220,250 are non-fixedly attached to the CRUs 210, 240 in a manner that may limit axial movement of the respective ring-like devices 220,250 with respect to the rotatable CRUs 210,240 without restricting independent rotational movement between the respective ring-like devices 220,250 and the rotatable CRUs 210,240.

Each of the ring-like devices 220,250 may provide a platform for accommodation of one or more electronically-readable monitoring modules in the form of CRUMs 230,260. The CRUMs 230,260 may be attached to the respective ring-like devices 220,250 in any conventional manner. For example, the CRUMs 230,260 may be adhered to an outer surface of the respective ring-like devices 220,250. Otherwise, the CRUMs 230,260 may be embedded within separate layers of material constituting the respective ring-like devices 220,250, thereby essentially embedding the CRUMs 230,260 within the respective ring-like devices 220,250.

In operation, the rotatable CRUs 210,240, as depicted in FIGS. 2A and 2B, may be rotatable in a clockwise direction. The individual structural projections 225,255 which form a part of the respective ring-like devices 220,250 may be provided at an appropriate advantageous position relative to the respective CRUMs 230,260. As the individual rotatable CRUs 210,240 are freely rotated in a clockwise direction from the random positionings for the individual rotatable CRUs 210,240 shown, for example, in FIG. 2A, it is anticipated that rotation of the respective ring-like devices 220,250 will generally conform to the rotation of the individual rotatable CRUs 210, 240.

The generally cooperative rotation of the individual rotatable CRUs 210,240 and the respective ring-like devices 220, 250 may be modified as the individual structural projections 225,255 make contact with particularly-configured stopping portions 272,274 of the stopping structure 270 in the manner shown in FIG. 2B. This mechanical interaction between the individual structural projections 225,255 and the particularly-configured stopping portions 272,274 may cause rotational movement of the ring-like devices 220,250 to be mechanically impeded. Further rotational movement of the individual rotatable CRUs 210,240 may not be likewise impeded. In other words, rotational sliding of the individual rotatable CRUs 210,240 with respect to the ring-like devices 220,250 may occur. Placement of the individual structural projections 225,255 is intended to arrest the rotating motion of the ring-like devices 220,250 in a particular position relative to the stopping structure 270.

A relative positioning of the individual structural projections 225,255 and the respective associated CRUMs 230,260 mounted on the ring-like devices 220,250 in an advantageous location is intended to result in an alignment of the CRUMs 230,260 with a CRUM reader 280 mounted on the stopping structure 270 for exchanging information with both of the CRUMs 230,260 when stopped in place as the individual rotatable CRUs 210,240 continue to rotate. At this point in operation, both rotatable CRUs 210,240 continue to rotate while the CRUM reader 280 communicates simultaneously with the two CRUMs 230,260. In embodiments, it may be advantageous to provide at least a layer of film to cover the CRUM reader 280 in an effort to prevent rotation of the individual structural projections 225,255 past the CRUM reader 280 prior to coming in cooperative contact with the particularly-configured stopping portions 272,274 from, for example, stubbing on exposed electrical components on the CRUM reader's 280 circuit board. In embodiments, rail-like features may be provided on the stopping structure 270 which are proud of CRUM reader 280 upon which projections 225, 255 may ride past any exposed electrical components.

As is generally shown in FIGS. 2A and 2B, an internal corner of each of the particularly-configured stopping portions 272,274 may have an appropriate lead-in ramp-like structure to aid in properly capturing and seating the respective individual structural projections 225,255.

In embodiments, depending on spacing between other CRUs (not shown) that are not intended to share communications with the CRUM reader 280 (for example, visualize additional toner bottles placed laterally to one side or the other of the depicted rotatable CRUs 210,240), structural baffles for walls 290,295 be appropriate to attempt to ensure that individual structural projections on such other CRUs do not interfere mechanically with one another, and signals that are intended to be exchanged between pairs of CRUMs with a particular CRUM reader do not communicatively interfere with one another. In further embodiments, a chamfer, for example, on an inboard edge of the individual structural protrusions 225,255 may aid in guiding individual structural projections 225,255 past walls 290,295 and/or the CRUM reader 280 on insertion of the respective CRUs 210,240 in the image forming device for use.

The CRUMs 230,260 are shown on the outside of the ring-like devices 220,250. As indicated above, however, the ring-like devices 220,250 may be placed on an inside of the ring-like devices 220,250. Particularly in instances where one or both of the CRUMs 230,260 are not placed on the outside of the ring-like devices 220,250, it may be preferable to place the CRUMs 230,260 in an overlapped area near a point of tangency and/or between layers of the material forming the ring-like devices 220,250, so as to avoid inducing wear directly between the CRUMs 230,260 and the CRUs 210,240.

The CRUMs 230,260 are generally depicted in FIGS. 2A and 2B as non-contact CRUMs communicating with the CRUM reader 280 via radio-frequency (RF) wireless transmission. Wired CRUM options are possible. In particular, wired CRUMs may be packaged with flexible contacts and adhered to the ring-like devices 220,250 generally in the configurations shown in FIGS. 2A and 2B, with cooperating terminals being mounted on the machine side CRUM reader 280 located in an appropriate position to accept physical contact with the flexible contacts of the CRUMs when the CRUMs are stopped in place with the disclosed mechanisms and schemes. The machine side CRUM reader 280 may be configured to apply, for example a slight pressure through the CRUMs and ring-like devices 220,250 against the CRUs 210, 240 to enhance contact.

A prototype of the disclosed ring-like device was sized for mounting on a particular configuration of a toner bottle. In the prototype, the ring-like device was formed from a strip of 0.18 mm polycarbonate approximately 18 mm wide and 295 mm long. A shape of the prototype ring-like device was held by means of three pairs of interlocking slits extending halfway across a width of the prototype ring-like device such that a tab extended for 34 mm tangent to the ring-like device. The prototype ring-like device was observed to slide smoothly over the blow-molded toner bottle and was retained in one direction by a ridge on the bottle. The ring-like device was observed to hold its place as the toner bottle was rotated, with accuracy more than sufficient for RF transmission to be established between a CRUM and a CRUM reader. While the prototype was held together by interlocking slits, other options for production may include heat sealing, crimping, stapling, and adhesives.

Figure 3:
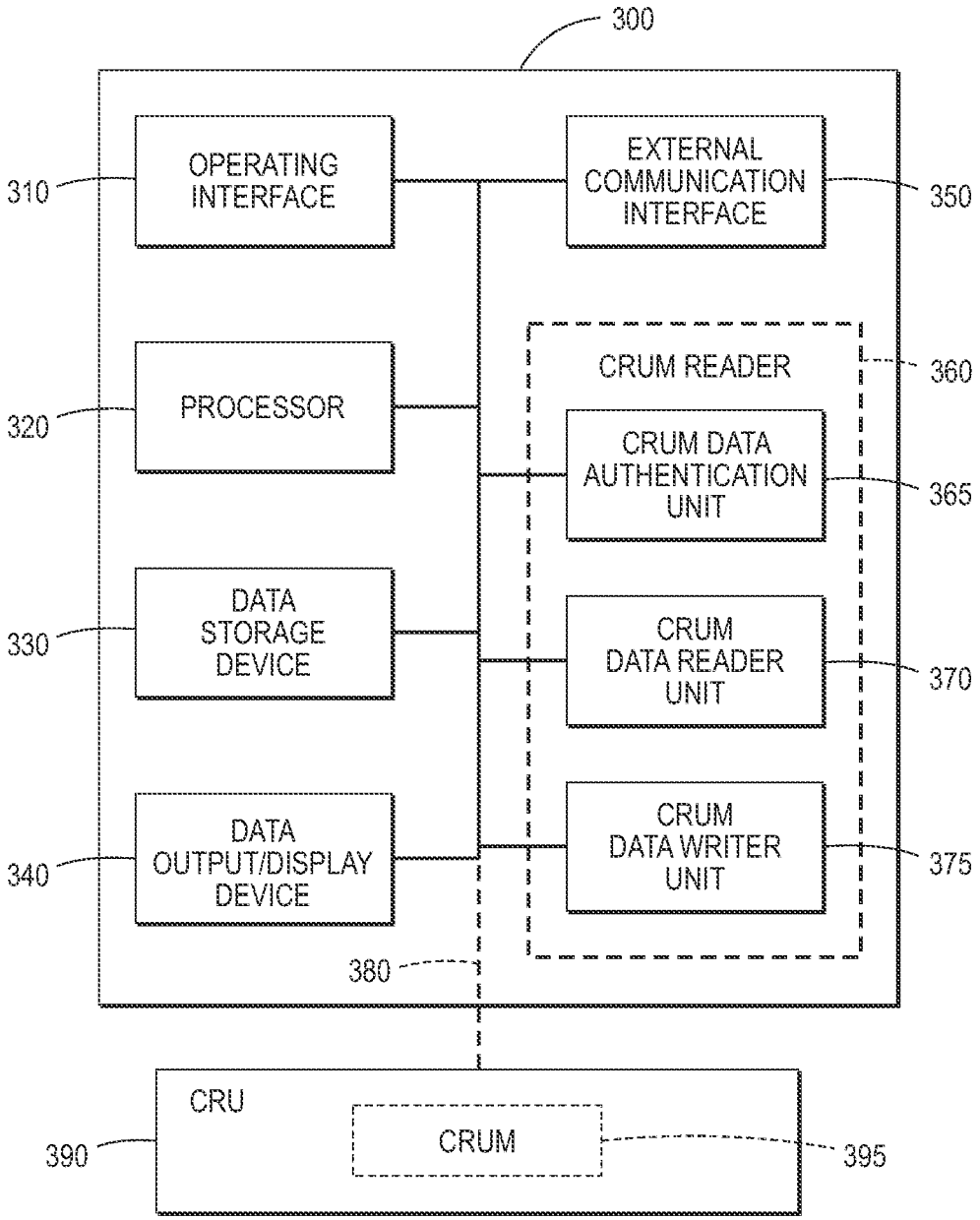
FIG. 3 illustrates a block diagram of an exemplary information exchange system in, or associated with, an image forming device including modules for facilitating information exchange with one or more CRUMs associated with CRUs in the image forming device according to this disclosure.

FIG. 3 illustrates a block diagram of an exemplary information exchange system 300 in, or associated with, an image forming device including modules for facilitating information exchange with one or more CRUMs associated with CRUs in the image forming device.

The exemplary information exchange system 300 may include an operating interface 310 by which a user may communicate with the exemplary information exchange system 300. The operating interface 310 may be a locally accessible user interface associated with the image forming device. The operating interface 310 may be configured as one or more conventional mechanisms common to image forming devices and/or computing devices that may permit a user to input information to the exemplary information exchange system 300. The operating interface 310 may include, for example, a conventional keyboard, a touchscreen with "soft" buttons or with various components for use with a compatible stylus, a microphone by which a user may provide oral commands to the exemplary information exchange system 300 to be "translated" by a voice recognition program, or other like device by which a user may communicate specific operating instructions to the exemplary information exchange system 300. The operating interface 310 may also be a part of a function of a graphical user interface (GUI) mounted on, integral to, or associated with, the image forming device with which the exemplary information exchange system 300 is associated.

The exemplary information exchange system 300 may include one or more local processors 320 for individually operating the exemplary information exchange system 300 and for carrying out operating functions of the image forming device, including executing an information exchange protocol between information exchange components of the exemplary information exchange system 300 and the one or more CRUMs associated with CRUs in the image forming device. Processor(s) 320 may include at least one conventional processor or microprocessor that interprets and executes instructions to direct specific functioning of the exemplary information exchange system 300.

The exemplary information exchange system 300 may include one or more data storage devices 330. Such data storage device(s) 330 may be used to store data or operating programs to be used by the exemplary information exchange system 300, and specifically the processor(s) 320. Data storage device(s) 330 may be used to collect information regarding a status of one or more CRUs that may be usable in the image forming device. The data storage device(s) 330 may include a random access memory (RAM) or another type of dynamic storage device that is capable of storing updatable database information, and for separately storing instructions for execution of system operations by, for example, processor (s) 320. Data storage device(s) 330 may also include a read-only memory (ROM), which may include a conventional ROM device or another type of static storage device that stores static information and instructions for processor(s) 320. Further, the data storage device(s) 330 may be integral to the exemplary information exchange system 300, or may be provided external to, and in wired or wireless communication with, the exemplary information exchange system 300.

The exemplary information exchange system 300 may include at least one data output/display device 340, which may be configured as one or more conventional mechanisms that output information to a user, including a display screen on a GUI of the image forming device or on a separate computing device in wired or wireless communication with the image forming device.

The exemplary information exchange system 300 may include one or more separate external data interfaces 350 by which the exemplary information exchange system 300 may communicate with components external to the exemplary information exchange system 300. At least one of the external data interfaces 350 may be configured as an output port for connection to, for example, a separate printer, a copier, a scanner, a multi-function device, or a remote storage medium, such as a digital memory in any form. Any suitable data connection in wired or wireless communication with an external data repository or external data storage device is contemplated to be encompassed by the depicted external data interface 350.

The exemplary information exchange system 300 may include a CRUM reader 360 as a part of a processor 320 coupled to, for example, one or more storage devices 330, or as a separate stand-alone component module or circuit in the exemplary information exchange system 300. The CRUM reader 360 may include at least a CRUM data authentication unit 365, a CRUM data reader unit 370 and a CRUM data writer unit 375. Via these separate units, the CRUM reader 360 of the exemplary information exchange system 300 may execute information exchange between the image forming device with which the exemplary information exchange system 300 is associated and individual CRUMs 395 associated with one or more CRUs 390 in the image forming device.

The CRUM data authentication unit 365 may be used to execute a data authentication scheme between the exemplary information exchange system 300 and one or more individual CRUMs 395 to verify that any data or information stored on the CRUMs 395 is genuine. Such a capability for the CRUM reader 360, via the CRUM data authentication unit 365, to verify the fidelity of data or information stored on the CRUM 395 may be particularly beneficial in executing schemes to inhibit image forming operations in the image forming device when data read from the CRUMs 395 cannot be properly authenticated making a source and/or a content of the CRUs 390 with which the CRUMs 395 are associated suspect.

The CRUM data reader unit 370 may be used to read data from the CRUM 395 while the CRUM data writer unit 375 may be used to write data to the CRUM 395 according to known methods and in support of information exchange schemes.

All of the various components of the exemplary information exchange system 300, as depicted in FIG. 3, may be connected internally, and to one or more CRUMs 395 associated with one or more CRUs 390 by one or more data/control busses 380. These data/control busses 380 may provide wired or wireless communication between the various components of the exemplary information exchange system 300, whether all of those components are housed integrally in, or are otherwise external and connected to an image forming device with which the exemplary information exchange system 300 may be associated. It should be recognized that at least the CRUMs 395 associated with the CRUs 390, as depicted in FIG. 3, are intended to establish wired or wireless communication once the CRUs 390 are installed in the image forming device to complete the exemplary information exchange system 300, as depicted.

It should be appreciated that, although depicted in FIG. 3 as an integral unit, the various disclosed elements of the exemplary information exchange system 300 may be arranged in any combination of sub-systems as individual components or combinations of components, integral to a single unit, or external to, and in wired or wireless communication with the single unit of the exemplary information exchange system 300. In other words, no specific configuration as an integral unit or as a support unit is to be implied by the depiction in FIG. 3. Further, although depicted as individual units for ease of understanding of the details provided in this disclosure regarding the exemplary information exchange system 300, it should be understood that the described functions of any of the individually-depicted components may be undertaken, for example, by one or more processors 320 connected to, and in communication with, one or more data storage device(s) 330.

Figure 4:
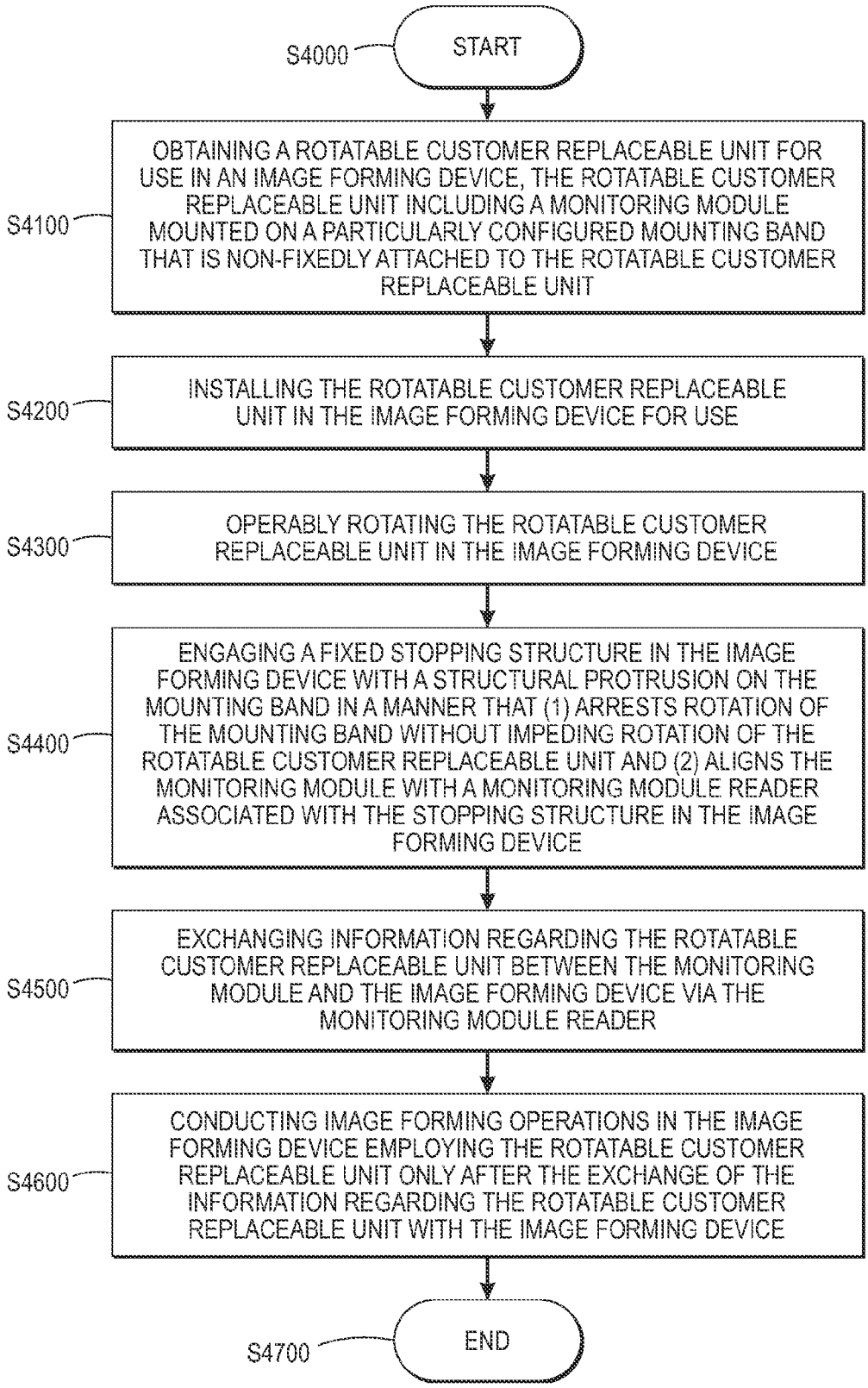
FIG. 4 illustrates a flowchart of an exemplary method for employing CRUMs advantageously mounted on particularly-configured rings formed of a flexible material accommodating CRUs as an information exchange medium via a CRUM reader installed in an image forming device according to this disclosure.

The disclosed embodiments may include an exemplary method for employing CRUMs advantageously mounted on particularly-configured rings formed of a flexible material accommodating CRUs as an information exchange medium via a CRUM reader installed in an image forming device. FIG. 4 illustrates a flowchart of such an exemplary method. As shown in FIG. 4, operation of the method commences at Step S4000 and proceeds to Step S4100.

In Step S4100, a rotatable CRU for use in an image forming device may be obtained. The rotatable CRU may include a CRUM mounted on a particularly-configured ring-like (mounting band) device. The particularly-configured ring-like device may be non-fixedly attached to the CRU in a manner that limits axial movement of the ring-like device with respect to the CRU, but does not impede relative rotational movement between the ring-like device and the CRU. Operation of the method proceeds to Step S4200.

In Step S4200, the rotatable CRU may be installed in the image forming device for use. Operation of the method proceeds to Step S4300.

In Step S4300, the rotatable CRU may be operably rotated in the image forming device. Operation of the method proceeds to Step S4400.

In Step S4400, a fixed stopping structure in the image forming device may be mechanically engaged with a structural projection on the mounting band of the ring-like device. This mechanical interaction between the structural projection and the fixed stopping structure in the image forming device may serve to arrest rotation of the mounting band, and the CRUM mounted thereon, with respect to fixed components in the image forming device including, for example, positioning the CRUM in an advantageous fixed position opposite a CRUM reader in the image forming device to implement high-fidelity of communications between the CRUM and the CRUM reader. In embodiments, multiple (at least two) CRUMs may be positioned in the manner disclosed to be read by the same CRUM reader. It is important to note that, although depicted above as showing only two CRUMs associated with a pair of CRUs being read by a same CRUM reader, this rendering should not be interpreted in any manner that may preclude or exclude larger numbers of CRUMs associated with respective CRUs being positioned to be read by a same CRUM reader. Operation of the method proceeds to Step S4500.

In Step S4500, information may be advantageously exchanged regarding characteristics of the rotatable CRU between the CRUM and the CRUM and the image forming device via the CRUM reader. Operation of the method proceeds to Step S4600.

In Step S4600, one or more image forming operations may be conducted in the image forming device employing the newly-installed rotatable CRU only after the exchange of information regarding the rotatable CRU with the image forming device. Operation of the method proceeds to Step S4700, where operation of the method ceases.

The above method may positively provide a level of inventory management and configuration control to the image forming device manufacturer as that image forming device manufacturer may maintain, for example, a database of information regarding compatible CRUs for use in particular classes or families of fielded image forming devices.

The disclosed embodiments may include a non-transitory computer-readable medium storing instructions which, when executed by a processor, may cause the processor to execute all, or at least some, of the steps of the method outlined above.

The above-described exemplary systems and methods reference certain conventional components known to those in the field of image forming devices to provide a brief, general description of suitable operating and image processing environments in which the subject matter of this disclosure may be implemented for familiarity and ease of understanding. Although not required, embodiments of the disclosure may be provided, at least in part, in a form of hardware circuits, firmware, or software computer-executable instructions to carry out specific information exchange functions, such as those described. These may include individual program modules executed by a processor. Generally, program modules include routine programs, objects, components, data structures, and the like that perform particular tasks or implement particular data types in support of the overall objective of the systems and methods according to this disclosure.

Those skilled in the art will appreciate that other embodiments of the disclosed subject matter may be practiced in image forming devices and other customer-controlled machinery and systems that may include rotatable CRUs of many different configurations. Embodiments according to this disclosure may be practiced in distributed image forming environments where tasks may be performed by local and remote devices that may, for example, remotely direct image forming operations in a particular image forming device and receive messages regarding the progress of the directed image forming operations or the status of one or more CRUs based on information read from individual CRUMs associated with those CRUs. Remotely-located devices and components may be linked to each other by hardwired links, wireless links, or a combination of both through a communication network. In a distributed computing environment, program modules may be located in both local and remote memory storage devices, including what is commonly referred to as cloud storage.

As indicated above, embodiments within the scope of this disclosure may also include computer-readable media having stored computer-executable instructions or data structures that can be accessed, read and executed by one or more processors. Such computer-readable media can be any available media that can be accessed by a processor, general purpose or special purpose computer. By way of example, and not limitation, such computer-readable media can comprise RAM, ROM, EEPROM, CD-ROM, flash drives, data memory cards or other analog or digital data storage device that can be used to carry or store desired program elements or steps in the form of accessible computer-executable instructions or data structures. When information is transferred or provided over a network or another communications connection, whether wired, wireless, or in some combination of the two, the receiving processor properly views the connection as a computer-readable medium. Thus, any such connection is properly termed a computer-readable medium. Combinations of the above should also be included within the scope of the computer-readable media for the purposes of this disclosure.

Computer-executable instructions include, for example, non-transitory instructions and data that can be executed and accessed respectively to cause a processor to perform certain of the above-specified functions, individually or in various combinations. Computer-executable instructions may also include program modules that are remotely stored for access and execution by a processor.

The exemplary depicted sequence of executable instructions or associated data structures represents one example of a corresponding sequence of acts for implementing the functions described in the steps of the above-outlined exemplary method. The exemplary depicted steps may be executed in any reasonable order to effect the objectives of the disclosed embodiments. No particular order to the disclosed steps of the method is necessarily implied by the depiction in FIG. 4, except where a particular method step is a necessary precondition to execution of any other method step.

Although the above description may contain specific details, they should not be construed as limiting the claims in any way. Other configurations of the described embodiments of the disclosed systems and methods are part of the scope of this disclosure. This is particularly true in this instance with regard to the specifically depicted physical structures of the CRUs and the associated ring-like devices, with their multiple characteristics including associated structural projections and CRUM mounting. The above description provides one general exemplary configuration of proposed interoperating structures in a manner that is not intended to imply any limitation to specific configurations of the relevant structures.

It will be appreciated that various of the above-disclosed and other features and functions, or alternatives thereof, may be desirably combined into many other different systems or applications. Also, various alternatives, modifications, variations or improvements therein may be subsequently made by those skilled in the art which are also intended to be encompassed by the following claims.

I claim:

1. An information exchange device, comprising:

a structural mounting component that is non-fixedly attached to an outer surface of a rotatable customer replaceable unit for use in a device, a structure of the rotatable customer replaceable unit limiting axial movement of the structural mounting component along a body of the rotatable customer replaceable unit, and the structural mounting component being free to rotate independent of a rotation of the rotatable customer replaceable unit;

a structural projection component that is at least one of formed on or attached to the structural mounting component and that projects in a direction away from the outer surface of the rotatable customer replaceable unit; and an electronically-readable monitoring module mounted to the structural mounting component that establishes data communication with a reader unit in the device when the rotatable customer replaceable unit is installed in the device for use, wherein the structural mounting component comprising a circumferential band formed of a flexible material and the flexible material being a plastic film.

2. The information exchange device of claim 1, the plastic film being a polycarbonate.

3. The information exchange device of claim 1, the electronically-readable monitoring module being mounted to the structural mounting component by adhering the electronically-readable monitoring module to an outer surface of the structural mounting component.

4. The information exchange device of claim 1, the flexible material being formed of a plurality layers, the electronically-readable monitoring module being mounted to the structural mounting component by embedding the electronically-readable monitoring module among the plurality of layers.

5. The information exchange device of claim 1, the structural projection component being configured to cooperate with a fixed structure in the device to arrest rotation of the structural mounting component while leaving the customer replaceable unit free to continue to rotate in operation in the device.

6. The information exchange device of claim 5, a relative positioning of the structural projection component and the electronically-readable monitoring module on the circumferential band causing the electronically-readable monitoring module to be stopped in a position directly facing the reader device in the image forming device when the rotation of the circumferential band is arrested.

7. The information exchange device of claim 6, the electronically-readable monitoring module wirelessly communicating with the reader device when stopped.

8. The information exchange device of claim 6, the electronically-readable monitoring module comprising at least one contact node extending from the electronically-readable monitoring module, the at least one contact node contacting the reader device when the electronically-readable monitoring module is stopped in the position directly facing the reader device, the at least one contact node contacting a cooperating terminal on a face of the reader device to establish wired communication between the electronically-readable monitoring module and the reader device.

9. An information exchange system in a device, comprising:

a fixed structure positioned in a vicinity of an operating position of at least one rotatable customer replaceable unit in the operating device;

an information exchange reader device positioned to cooperate with the fixed structure;

at least one rotatable customer replaceable unit installed in the operating device for use, the at least one rotatable customer replaceable unit comprising:

a structural mounting component that is non-fixedly attached to an outer surface of the rotatable customer replaceable unit, the structural mounting component being free to rotate independent of a rotation of the rotatable customer replaceable unit;

at least one physical structure on the outer surface of the rotatable customer replaceable unit that limits axial movement of the structural mounting component along a body of the rotatable customer replaceable unit;

a structural projection component on the structural mounting component that is at least one of formed on or attached to the structural mounting component and that projects in a direction away from the outer surface of the rotatable customer replaceable unit; and an electronically-readable monitoring module mounted to the structural mounting component that establishes data communication with the information exchange reader device when the rotatable customer replaceable unit is installed in the operating device for use, wherein the structural mounting component comprising a circumferential band formed of a flexible material, the flexible material being formed of a plurality layers, the electronically-readable monitoring module being mounted to the structural mounting component by embedding the electronically-readable monitoring module among the plurality of layers.

10. The information exchange system of claim 9, the information exchange reader device being mounted on the fixed structure.

11. The information exchange system of claim 9, the electronically-readable monitoring module being mounted to the structural mounting component by adhering the electronically-readable monitoring module to an outer surface of the structural mounting component.

12. The information exchange system of claim 9, the structural projection component being configured to cooperate with a fixed structure to arrest rotation of the circumferential band while leaving the customer replaceable unit free to continue to rotate in operation in the image forming device.

13. The information exchange system of claim 12, a relative positioning of the structural projection component and the electronically-readable monitoring module on the structural mounting component causing the electronically-readable monitoring module to be stopped in a position directly facing the information exchange reader device in the image forming device when the rotation of the circumferential band is arrested.

14. The information exchange system of claim 13, the electronically-readable monitoring module wirelessly communicating with the information exchange reader device when stopped.

15. The information exchange system of claim 13, the information exchange reader device having at least one contact terminal on a surface facing the electronically-readable monitoring module, the electronically-readable monitoring module having at least one contact node extending a surface facing the information exchange reader device, and the at least one contact node contacting the at least one contact terminal to establish wired communication between the electronically-readable monitoring module and the information exchange reader device when the electronically-readable monitoring is stopped in the position directly facing the information exchange reader device.

16. The information exchange system of claim 14, further comprising at least one separate physical structure to separate a first space in which the at least two rotatable customer replaceable units are operating and communicating with the information exchange reader device and a second space in which the other rotatable customer replaceable units are operating that are not communicating with the information exchange reader device.

17. The information exchange system of claim 9, the fixed structure being positioned the operating positions of at least two rotatable customer replaceable units in the device, the information exchange reader device being mounted on the fixed structure and configured to cooperatively communicate with at least a first electronically-readable monitoring module mounted to the structural mounting component of a first one of the at least two rotatable customer replaceable units and a second electronically-readable monitoring module mounted to the structural mounting component of a second one of the at least two rotatable customer replaceable units.

18. A method for exchanging information in a device, comprising:

providing a fixed structure positioned between at least two operating positions of at least two rotatable customer replaceable units in the device;

providing an information exchange reader device mounted to the fixed structure;

installing at least two rotatable customer replaceable units in the at least two operating positions in the device for operation, each of the at least two rotatable customer replaceable units comprising:

a structural mounting component that is non-fixedly attached to an outer surface of each of the rotatable customer replaceable units, the structural mounting component being free to rotate independent of a rotation of the rotatable customer replaceable unit;

at least one physical structure on the outer surface of the rotatable customer replaceable unit that limits axial movement of the structural mounting component along a body of the rotatable customer replaceable unit;

a structural projection component on the structural mounting component that is at least one of formed on or attached to the structural mounting component and that projects in a direction away from the outer surface of the rotatable customer replaceable unit; and an electronically-readable monitoring module mounted to the structural mounting component that establishes data communication with the information exchange reader device when the rotatable customer replaceable unit is installed in the device for operation;

rotating the at least two rotatable customer replaceable units in their respective operating positions until the respective structural projection components abut the fixed structure arresting rotation of the structural mounting components of the at least two rotatable customer replaceable units while leaving the at least two customer replaceable units free to continue to rotate in operation in the device; and establishing at least one of wireless or wired communication between the electronically-readable monitoring modules and the information exchange reader device when the electronically-readable monitoring modules are stopped.

* * * * *